US009739558B2

(12) United States Patent
Lee

(10) Patent No.: US 9,739,558 B2
(45) Date of Patent: Aug. 22, 2017

(54) BARREL SYSTEM FOR A FIREARM

(71) Applicant: APEX TACTICAL SPECIALTIES, INC., Los Osos, CA (US)

(72) Inventor: Randall M. Lee, Los Osos, CA (US)

(73) Assignee: Apex Tactical Specialties, Inc., Peoria, AZ (US)

( * ) Notice: Subject to any disclaimer, the term of this patent is extended or adjusted under 35 U.S.C. 154(b) by 0 days.

(21) Appl. No.: 14/746,845

(22) Filed: Jun. 23, 2015

(65) Prior Publication Data

US 2016/0377365 A1 Dec. 29, 2016

(51) Int. Cl.

| | |
|---|---|
| ***F41A 21/00*** | (2006.01) |
| ***F41A 5/18*** | (2006.01) |
| ***F41A 3/54*** | (2006.01) |
| ***F41A 5/04*** | (2006.01) |

(52) U.S. Cl.

CPC ..... *F41A 21/00* (2013.01); *F41A 3/54* (2013.01); *F41A 5/04* (2013.01); *F41A 5/18* (2013.01)

(58) Field of Classification Search

CPC ... F41A 21/00; F41A 21/26; F41A 5/00–5/36; F41A 17/00; F41A 17/42; F41A 3/00–3/94

USPC .... 42/14–18, 44, 69.01–69.02, 70.01, 70.11, 42/71.02, 75.01–75.02, 76.01, 106, 108; 89/132, 137, 139, 142, 148, 153, 89/160–163, 168–176, 180, 187.01–190, 89/14.05

See application file for complete search history.

(56) References Cited

U.S. PATENT DOCUMENTS

| | | | | |
|---|---|---|---|---|
| 3,745,881 | A * | 7/1973 | Roy | F41A 17/36 89/138 |
| 3,756,120 | A * | 9/1973 | Roy | F41A 5/04 89/163 |
| 4,361,975 | A * | 12/1982 | Wilhelm | F41A 19/48 42/69.01 |
| 4,539,889 | A * | 9/1985 | Glock | F41A 5/04 89/147 |
| 5,050,481 | A * | 9/1991 | Knight, Jr. | F41A 5/06 42/69.02 |
| 5,216,191 | A * | 6/1993 | Fox | F41A 3/12 42/70.05 |

(Continued)

OTHER PUBLICATIONS

Brandon Louis Clark, Effect of Barrel Length on the Muzzle Velocity and Report from a Mosin-Nagant 7.62x54R Rifle, May 2011, University of South Florida, pp. 1-3.*

*Primary Examiner* — Stephen M Johnson
*Assistant Examiner* — Benjamin Gomberg
(74) *Attorney, Agent, or Firm* — Fitch, Even, Tabin & Flannery LLP

(57) ABSTRACT

A barrel assembly for use in a semiautomatic firearm, including a barrel and a takedown lever. A rear portion of the barrel includes a follower lug and a rear lug extending from an underside of the rear portion. The follower lug further includes a follower notch. A pin of the takedown lever includes a notch with a vertical face configured to contact a vertical face of the follower notch when the firearm is in the locked position. The rear lug is configured to be supported by a portion of a locking block of the firearm prior to firing and during a portion of the recoil period. The modifications to the barrel assembly result in increased dwell time and accuracy of the firearm.

6 Claims, 10 Drawing Sheets

(56) References Cited

U.S. PATENT DOCUMENTS

| | | | | | |
|---|---|---|---|---|---|
| 5,669,169 | A * | 9/1997 | Schmitter | F41A 3/66 | 42/71.02 |
| 5,741,996 | A * | 4/1998 | Ruger | F41A 3/66 | 42/16 |
| 6,665,973 | B1 * | 12/2003 | Peev | F41A 19/33 | 42/69.01 |
| 6,993,864 | B1 | 2/2006 | OClair | | |
| 7,392,611 | B2 | 7/2008 | Curry | | |
| 7,617,628 | B2 | 11/2009 | Curry | | |

* cited by examiner

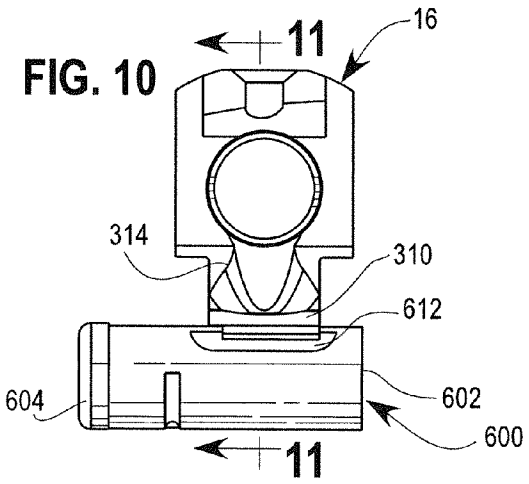
FIG. 10
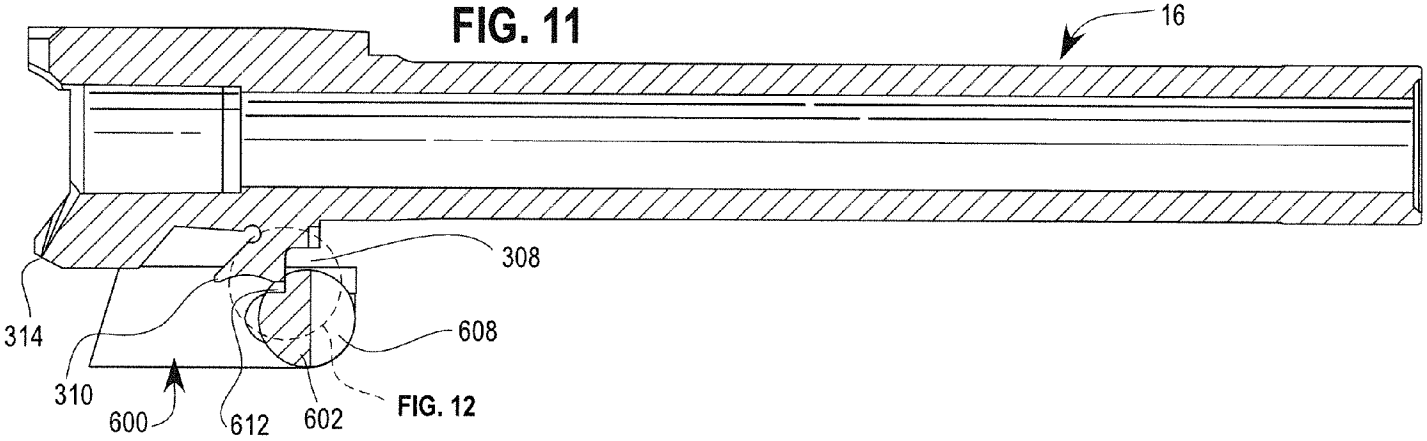
FIG. 11
FIG. 12

BARREL SYSTEM FOR A FIREARM

BACKGROUND OF THE INVENTION

1. Field of the Invention

The present invention relates generally to semi-automatic firearms, and more specifically to barrels and takedown levers for semi-automatic firearms.

2. Discussion of the Related Art

Some semiautomatic pistols utilize a short-recoil mechanism, where both the barrel and slide move together rearward upon discharge of the firearm. Prior to firing of the cartridge, the barrel is engaged to the slide by a locking mechanism, in some embodiments including a locking block. After firing, the recoil force drives both the barrel and the slide rearward, but since they are in engagement, the extraction of the casing has not started. After the initial recoil period has passed, an actuator (in some embodiments an upper projection of the locking block that engages with a portion of the barrel) begins to disengage the barrel from the slide. The rearward movement of the barrel is arrested, while the slide continues rearward and begins extraction of the casing using its kinetic energy and the residual gas pressure in the barrel. The slide continues until full rearward travel is reached.

Modern semi-automatic firearms may include a takedown lever. One use of the takedown lever is for assembling and disassembling the firearm. In one position the takedown lever prevents removal of the slide assembly, but when the takedown lever is manually positioned out of the retention position the slide and barrel assembly are removable without tools.

In some firearm configurations, the takedown lever is also involved in the firing process. In some takedown lever designs, the internal portion of the takedown lever can interact with the barrel during the firing process. The interaction between the takedown lever and the barrel during firing may cause the barrel to skew out of alignment during firing, adversely affecting the accuracy of the firearm. Additionally, the interaction may cause the barrel to drop out of battery after firing.

SUMMARY OF THE INVENTION

Several embodiments of the invention advantageously address the needs above as well as other needs by providing a barrel assembly for a firearm, comprising: a barrel comprising: a follower lug extending downward from an underside of a rear portion of the barrel proximate to a front portion of the barrel, the follower lug including a follower notch in a bottom portion of a front face of the follower lug, the follower notch including a vertical follower notch face facing frontwards; and a takedown lever mechanically cooperated with the barrel and a locking block of the firearm, the takedown lever including a cylindrical pin rotationally coupled to the locking block, a primary notch facing forwards, and a second notch in a top portion of the pin and facing rearwards, the second notch including a vertical second notch face and a horizontal second notch face, wherein when the firearm is in a locked position, the vertical follower notch face contacts the vertical second notch face, whereby further forward movement of the barrel is prevented.

In another embodiment, the invention can be characterized as a takedown lever for a firearm comprising: a cylindrical pin rotationally coupled to a locking block of the firearm and including a primary notch on a side of the pin facing a front of the firearm when the firearm is in a locked position, and a second notch on a top portion of a side of the pin facing a rear of the firearm when the firearm is in a locked position, the second notch including a vertical second notch face and a horizontal second notch face; and an ear coupled to a first end of the pin and extending perpendicularly from the pin in a generally horizontal direction when the firearm is in the locked position.

In a further embodiment, the invention may be characterized as a barrel for a firearm, comprising: a front portion; and a rear portion including a follower lug extending downward from an underside of the rear portion proximate to the front portion, the follower lug including a follower notch in a bottom portion of a front face of the follower lug, the follower notch including a vertical follower notch face facing frontwards and configured to contact a takedown lever vertical face when the firearm is in a locked position.

In yet another embodiment, the invention may be characterized as a method for operating a semi-automatic firearm comprising the steps of: locking of the barrel in a forward position after a cartridge has been loaded into the barrel, the locking of the barrel including a forward-facing vertical face of a follower notch of the follower lug of the barrel contacting a rearward-facing vertical face of a second notch of a takedown lever of the firearm, whereby forward movement of the barrel is restricted when the barrel is locked in the forward position, the locking position also including a downward-facing horizontal face of a rear lug of the barrel seated on an upward-facing horizontal face of an upper portion of a locking block of the firearm; and firing of the firearm, wherein the barrel travels rearward with respect to the locking block of the firearm, wherein the rear lug slides horizontally rearward along the horizontal face of the upper portion, until the rear lug horizontal surface has moved past an extent of the upper portion, whereby the rear portion moves downward, wherein the upper portion slides into the recess groove formed between the follower and the rear lug, whereby movement of the barrel is arrested.

BRIEF DESCRIPTION OF THE DRAWINGS

The above and other aspects, features and advantages of several embodiments of the present invention will be more apparent from the following more particular description thereof, presented in conjunction with the following drawings.

FIG. 10 is a front elevational view of the barrel assembly.

FIG. 11 is a cross-sectional view of the barrel assembly.

Figure 1:
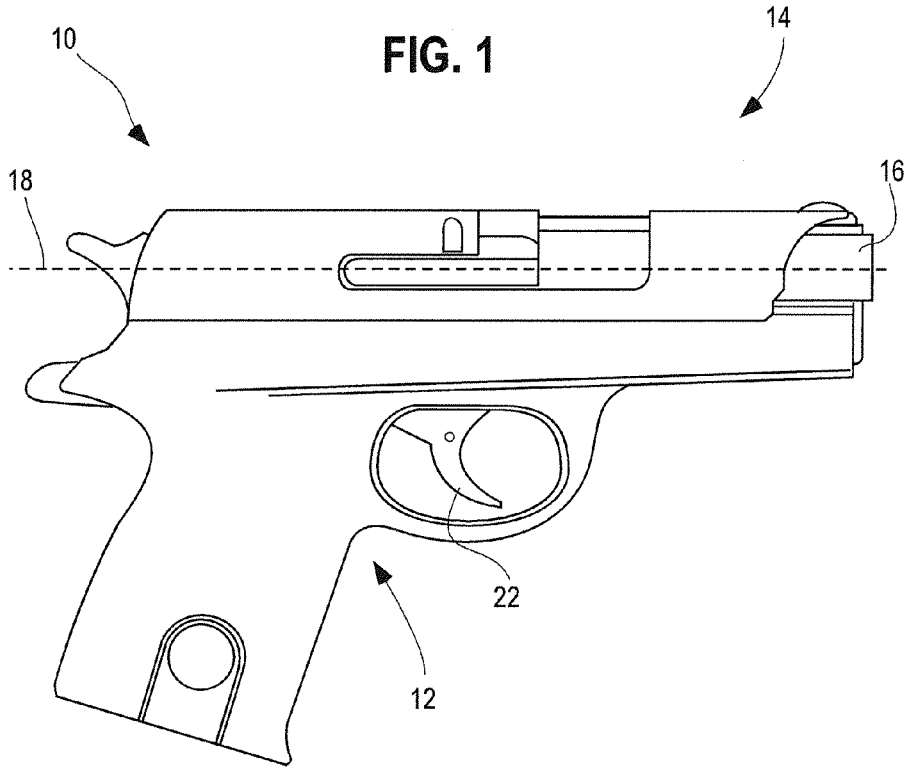
FIG. 1 is a side elevational view of a firearm in the locked position, in accordance with an embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 2:
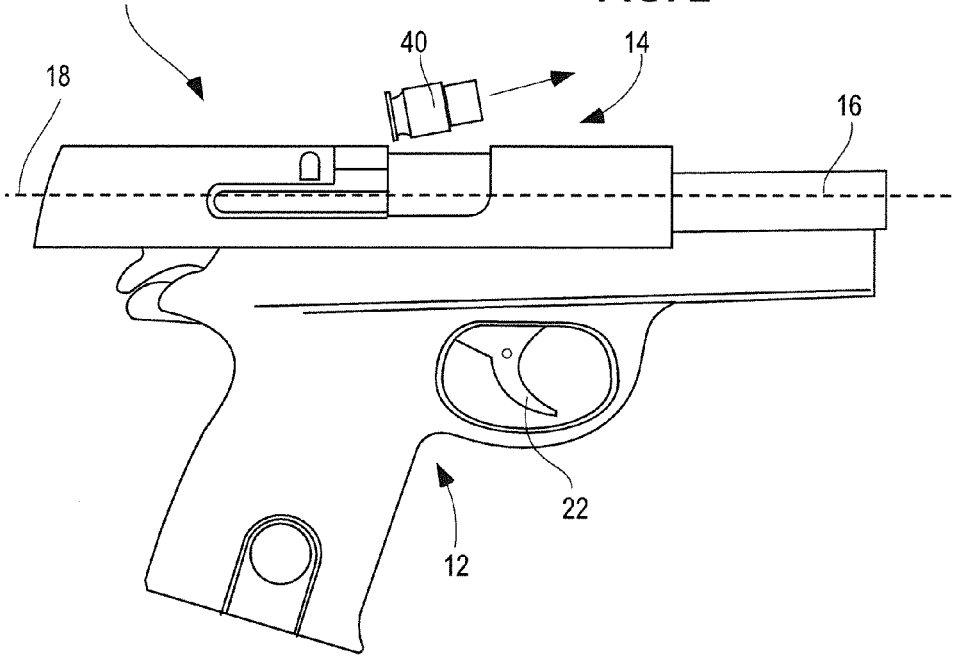
FIG. 2 is a side elevational view of the firearm in the fully recoiled position, in accordance with an embodiment of the present invention.

Referring first to FIGS. 1 and 2, a semiautomatic firearm or pistol 10 is shown, generally referred to hereinafter as the firearm 10. The firearm 10 comprises a frame 12, a slide 14, a barrel 16, and an internal fire control mechanism (not shown). The barrel 16 is disposed at the front aperture of the slide 14 and is cooperatively linked therewith, and, together with the slide 14, defines a longitudinal firing axis 18. The barrel 16 has a rearward end adapted for receiving an ammunition cartridge. A trigger 22 is pivotally mounted to the frame 12 to actuate the fire control mechanism to fire the firearm 10. The frame 12 is fabricated of a polymer material, metal, or a combination of polymer and metal.

The slide 14 is fitted to opposingly positioned rails (not shown) of the frame 12 to effect the reciprocal movement of the slide 14 along a longitudinal firing axis 18. The rails extend along the underside of the slide 14 in the longitudinal direction and are cooperative with the frame 12 to allow the cycling of the slide 14 between forward (battery) and rearward (retired) positions. The firearm 10 also includes an internal locking block 1400 in cooperation with the slide 14 and the barrel 16, which is configured to lock the barrel 16 to the slide 14 prior to firing.

The cooperation of the frame 12, the slide 14, the barrel 16, and the firing mechanism during the loading, firing of a cartridge, and ejecting of a spent casing 40 for the firearm 10 of the present type can be understood by referring to U.S. Pat. No. 7,617,628 (Curry) and U.S. Pat. No. 6,993,864 (O'Clair et al.), the entirety of which are incorporated herein by reference. The cooperation of a takedown lever 600 with the trigger assembly can be understood by referring to U.S. Pat. No. 7,392,611 (Curry), the entirety of which is incorporated herein by reference.

Figure 3:
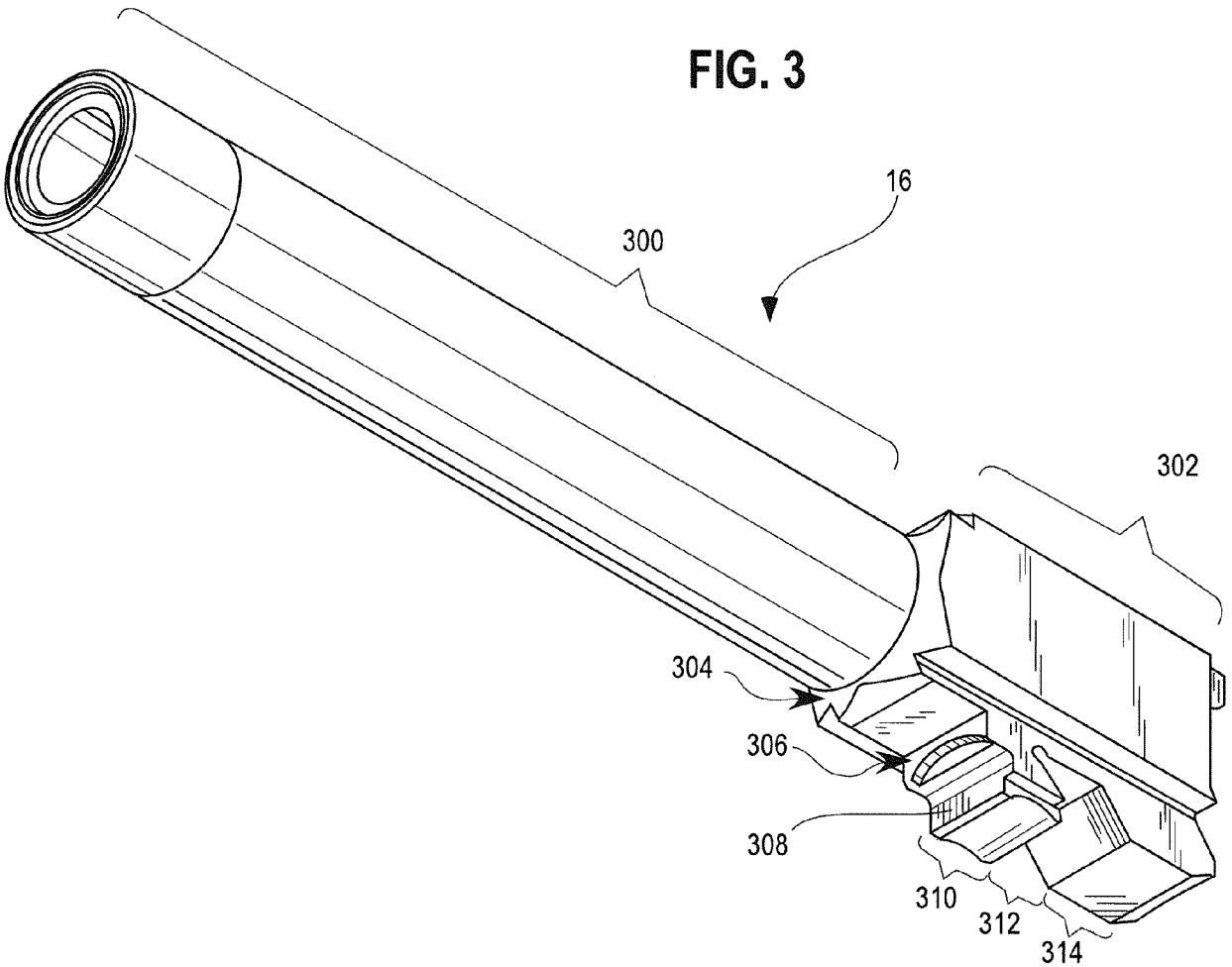
FIG. 3 is a perspective view of a barrel of the firearm in one embodiment of the present invention.
Figure 4:
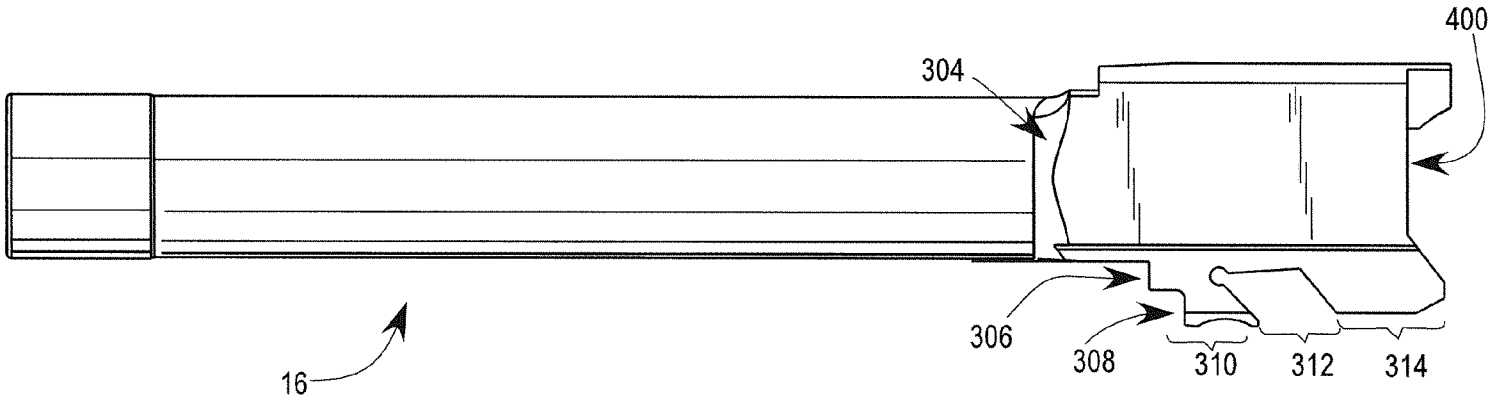
FIG. 4 is a side elevational view of the barrel of the firearm.
Figure 5:
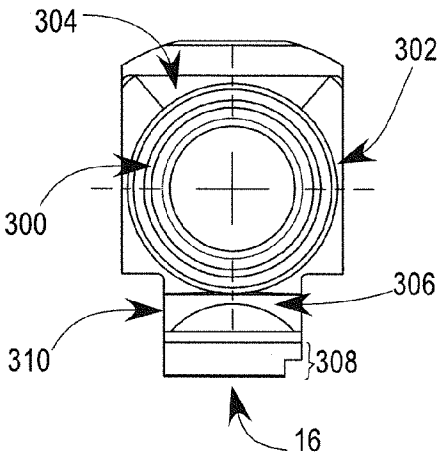
FIG. 5 is a front elevational view of the barrel of the firearm.

Referring next to FIGS. 3, 4 and 5, a perspective view, a side elevational view, and a front elevational view of the barrel 16 are respectively shown. Shown are the barrel 16, a front portion 300, a rear portion 302, a front end face 304, a follower lug front face 306, a follower notch 308, a follower lug 310, a recess groove 312, a rear lug 314, and a rear end face 400.

The barrel 16 includes the tubular front portion 300, and the rear portion 302 with a generally rectangular exterior profile. The rear portion 302 includes the front end face 304 where the rear portion 302 intersects the front portion 300, and the rear end face 400 at a rear end of the rear portion 302 of the barrel 16. The rear portion 302 includes two lugs extending from the underside of the rear portion 302: the follower lug 310 proximate to the front end face 304, and the rear lug 314 proximate to the rear end face 400. As known in the prior art, the follower lug 310 is configured to receive an end of the recoil spring assembly (not shown). Follower lug 310 receives a recoil spring guide rod head and acts as a centering pilot for the recoil assembly as one reassembles the slide assembly onto the frame 12. Once the slide is back on the frame 12, the recoil spring guide rod only contacts primary notch 608 of the takedown lever 600. In the present invention, the follower lug front face 306 extends downward from an underside of the rear portion 302 of the barrel 16 proximate to the front end face 304, forming a surface substantially perpendicular to the underside face of the rear portion 302, and facing towards the front portion 300 of the barrel 16. In the embodiment shown in FIGS. 3-5, the recoil spring guide rod head is received by an arcuate indentation in the follower lug front face 306.

The follower lug 310 also includes the follower notch 308 in a bottom portion of the follower log front face. The follower notch 308 extends rearward from the follower lug front face 306. In one embodiment, when viewed from a side of the barrel 16 as shown in FIG. 4, the follower notch 308 begins 0.1 inches vertically downward from the intersection of the follower lug front face 306 with the underside of the rear portion 302 of the barrel 16. In one embodiment the notch extends horizontally 0.124" towards the rear end face 400 of the barrel 16. The notch is formed of substantially perpendicular surfaces: a vertical follower lug face facing frontwards, and a horizontal follower lug face facing downwards. The corners formed by face intersections may be rounded. A bottom surface of the follower lug 310 extends rearward from the follower notch 308, and is generally oriented in a horizontal plane. The bottom surface of the follower lug 310 may include an arcuate surface as shown in FIG. 4. A follower lug rear face is angled towards the front of the barrel 16, as shown in FIG. 4.

The rear lug 314 extends downward from the underside of the rear portion 302 of the barrel 16 proximate to the rear end face 400 (i.e. distal to the front portion 300 of the barrel 16), and typically includes a rear lug front face and a rear lug rear face that are angled towards the front of the barrel 16, as shown in FIG. 4. A rear lug rear edge extends past the rear of the barrel 16. A rear lug bottom surface is generally flat and oriented in a horizontal plane.

The recess groove 312 is forming between the follower lug 310 and the rear lug 314. The shape and extent of the recess groove 312 and juxtaposed surfaces of the follower lug 310 and rear lug 314 are configured to cooperate with an upper projection 1402 of the locking block 1400 during recoil, with the rear face of the follower lug 310 contacting the upper projection 1402 of the locking block 1400 and guiding the rear portion 302 of the barrel 16 downwards such that the upper projection 1402 generally fits within the recess groove 312. The operation of the firearm 10 during firing and recoil is described further below in FIGS. 13-20.

The rear lug 314 is further configured such that when the firearm 10 is in the locked position prior to firing, a front portion of the rear lug bottom surface is juxtaposed with a rear portion of a top surface of the upper projection 1402 of the locking block 1400, whereby the barrel 16 is supported on the rear portion of the upper projection 1402. The rear lug 314 is further configured such that the barrel 16 remains supported by the upper projection 1402 during an initial portion of the recoil stage, as described further below in FIGS. 13-16.

Figure 7:
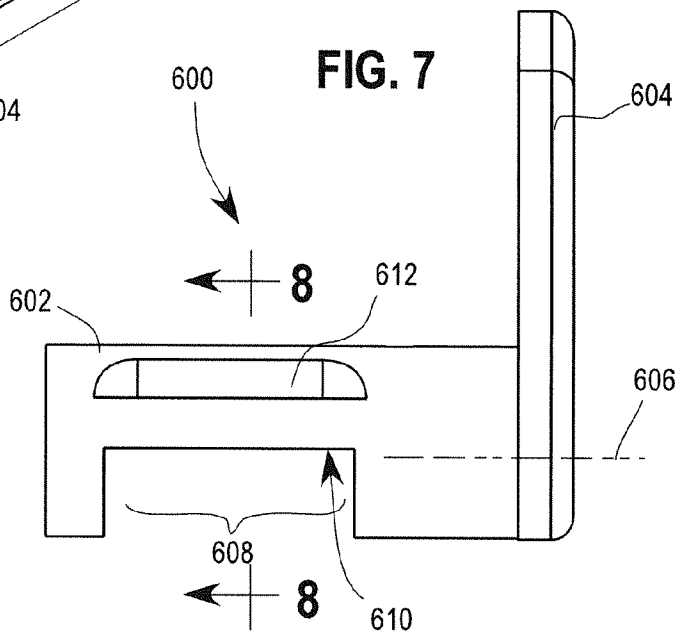
FIG. 7 is a plan view of the takedown lever.
Figure 6:
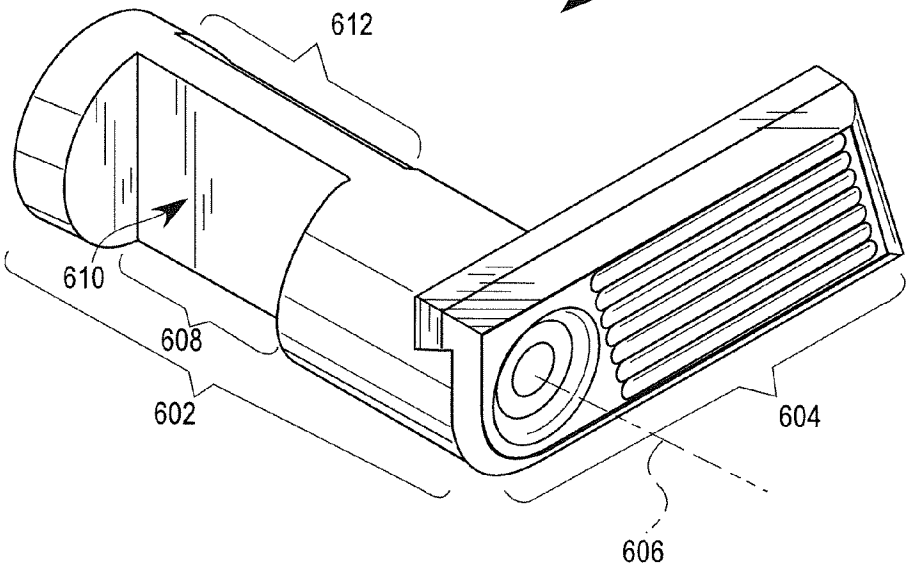
FIG. 6 is a perspective view of a takedown lever of the firearm in accordance with one embodiment of the present invention.
Figures 8, 9:
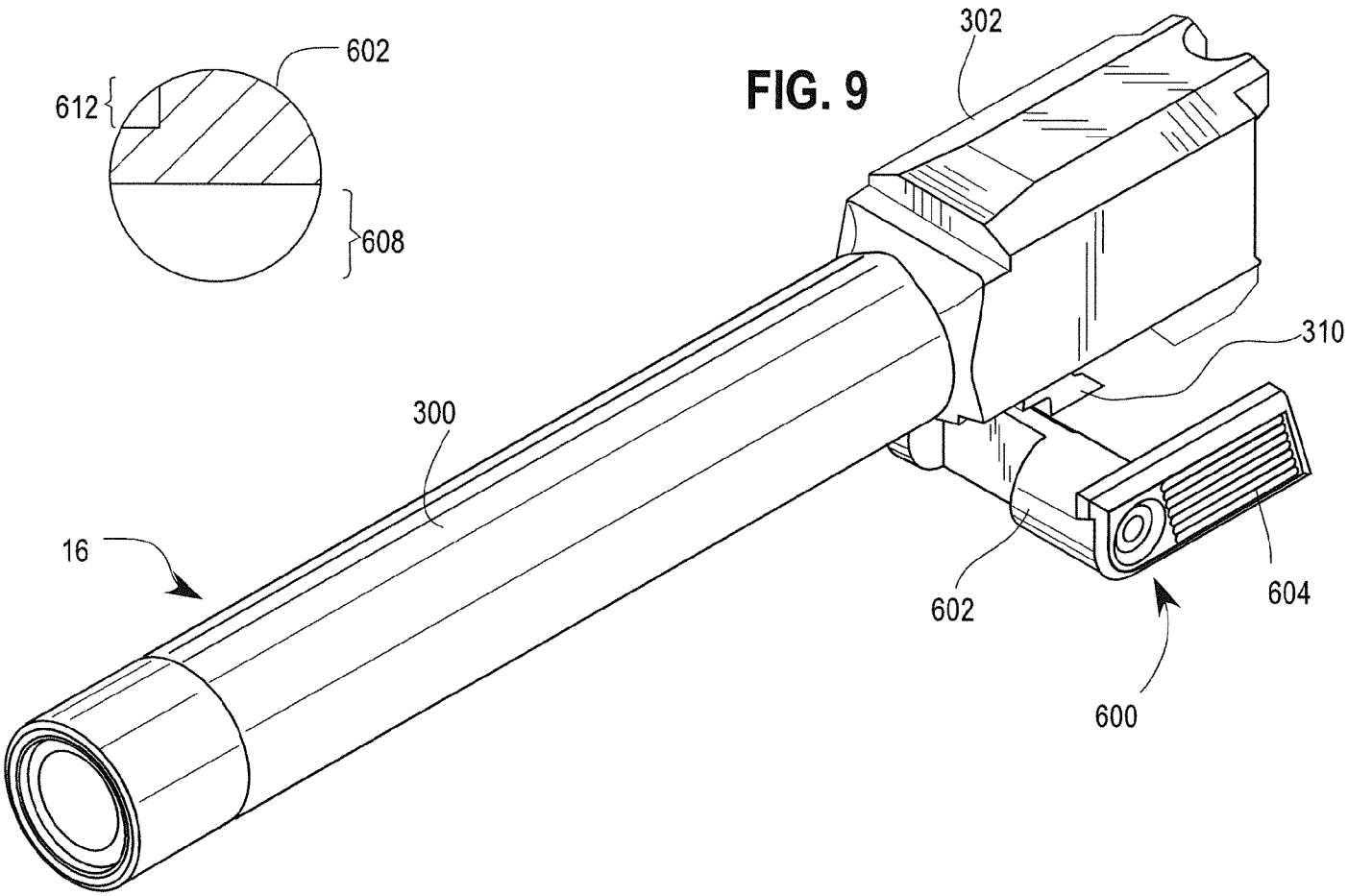
FIG. 8 is a cross-sectional view of the takedown lever.
FIG. 9 is a perspective view of a barrel assembly comprising the barrel and the takedown lever, in accordance with one embodiment of the present invention.

Referring next to FIGS. 6-8, a perspective view, a plan view, and a section view of the takedown lever 600 are shown respectively in one embodiment of the present invention. Shown are a pin 602, an ear 604, a pin longitudinal axis 606, a primary notch 608, a minor surface 610, and a second notch 612.

As is known in the prior art, the takedown lever 600 primarily comprises the cylindrical pin 602, which when installed in the firearm 10 is laterally positioned through the locking block 1400 of the firearm 10. The pin 602 includes the primary notch 608 including the minor surface 610 that is substantially flat and which extends along at least a portion of the longitudinal axis 606 of the pin 602. In cross-section, as shown in FIG. 8, the notch results in a generally semicircular section of the pin 602 at the notch location.

The prior art takedown notch also includes the ear 604, one end of which is coupled to one end of the takedown pin 602, forming an L-shape. The ear 604 extends substantially radially from the longitudinal axis 606 of the takedown pin 602 (i.e. is perpendicular to the longitudinal axis 606) and has a surface that can be engaged by a user and rotated about the longitudinal axis 606, whereby the rotation of the takedown lever 600 allows a portion of the firearm 10 to be disassembled as known in the prior art. In the locked position, the ear 604 is generally horizontal and flush with the exterior of the frame 12, as known in the prior art.

In accordance with one embodiment of the present invention, the pin 602 also includes the second notch 612. The second notch 612 is oriented substantially parallel to the takedown pin longitudinal axis 606, and in cross-section forms a shallow V-shape, with the legs of the V generally perpendicular and one leg of the V parallel to the face of the primary notch 608, forming two surfaces: a generally horizontal second notch face and a generally vertical second notch face. The ends of the second notch 612 may be tapered, as shown in FIG. 7, for example, as part of a milling technique or to eliminate stress risers at termination points. As shown in FIGS. 6-8, when the takedown lever 600 is installed in the locking block 1400 of the firearm 10 and the minor surface 610 of the primary notch 608 is oriented vertically (thus the takedown ear 604 is substantially horizontal), the second notch 612 has one substantially vertical face facing rearward and one substantially horizontal face and facing upward.

The addition of the second notch 612 of the takedown lever 600 provides the rear-facing vertical second notch face when the takedown lever 600 is in the assembled position (i.e. the frame 12 is locked). The vertical second notch face is configured to juxtapose with the vertical, frontward-facing face of the follower notch 308 when the firearm 10 is locked prior to firing, as described further below.

Figure 12:
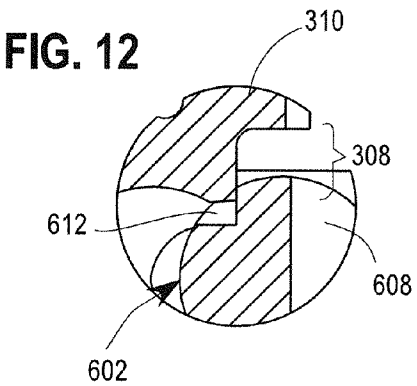
FIG. 12 is a detail of the cross-sectional view shown in FIG. 11.

Referring next to FIGS. 9-12, the combination of the barrel 16 and the takedown lever 600 when assembled in the firearm 10 and the firearm 10 is in the locked position before firing is shown in one embodiment of the present invention. A perspective view is shown in FIG. 9, a rear elevational view is shown in FIG. 10, a longitudinal section is shown in FIG. 11, and a detail of the longitudinal section is shown in FIG. 12. Shown in FIGS. 9-12 are the barrel 16, the front portion 300, the rear portion 302, the follower lug 310, the rear lug 314, the takedown lever 600, the pin 602, the ear 604, the second notch 612, and the primary notch 608.

When the barrel 16 and slide 14 are in the forward locked position prior to firing (as shown below in FIGS. 13 and 14), in the present invention contact between the barrel 16 and the takedown lever 600 takes place only between the follower lug 310 and the second notch 612 of the takedown pin 602. More specifically, only the forward-facing, vertical surface of the follower notch 308 contacts the rearward-facing, vertical surface of the second notch 612 of the takedown pin 602. In other words, the geometrical configuration of both the notch in the follower lug 310 and the second notch 612 of the takedown pin 602 are such that, when in the locked position, the vertical faces of the notches contact each other, and additionally, no other surfaces of the barrel 16 and the takedown lever 600 are in contact. For example, the depth of the second notch 612 in the vertical direction is such that the follower lug 310 does not contact the upward-facing surface of the second notch 612.

In one embodiment, the vertical second notch face is located 0.0785 inches from a parallel plane through a center of the pin 602. In another embodiment, the horizontal second notch face is located 0.0785 inches from a parallel plane through the center of the pin 602.

As is described further below in FIGS. 13-20, the configurations of the second notch 612 and the follower lug 310 provide a consistent contact surface location between the takedown lever 600 and the barrel 16. As both surfaces are vertical, contact takes place at the same location every time the firearm 10 is locked in the firing position. Additionally, the contact surfaces prevent the barrel 16 from moving farther forward when in the locked position.

Referring next to FIGS. 13-20, a series of sections and front elevations of a portion of the firearm 10 are shown illustrating the operation of the firearm 10, including the barrel 16, takedown lever 600, and locking block 1400 of the present invention. Shown are the slide 14, the barrel 16, the follower lug 310, the recess groove 312, the rear lug 314, the takedown lever 600, the locking block 1400, and the upper projection 1402.

Figure 13:
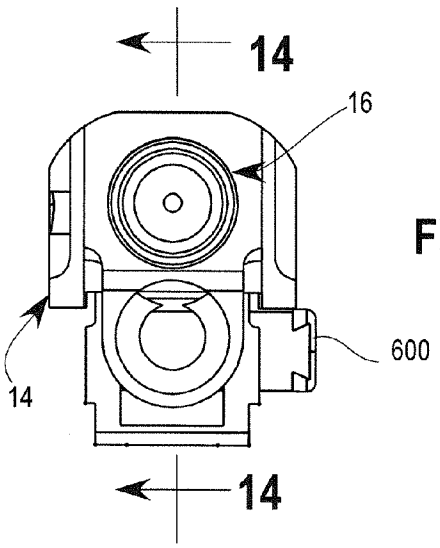
FIG. 13 is a front elevational view of a portion of the firearm in a locked position.
Figure 14:
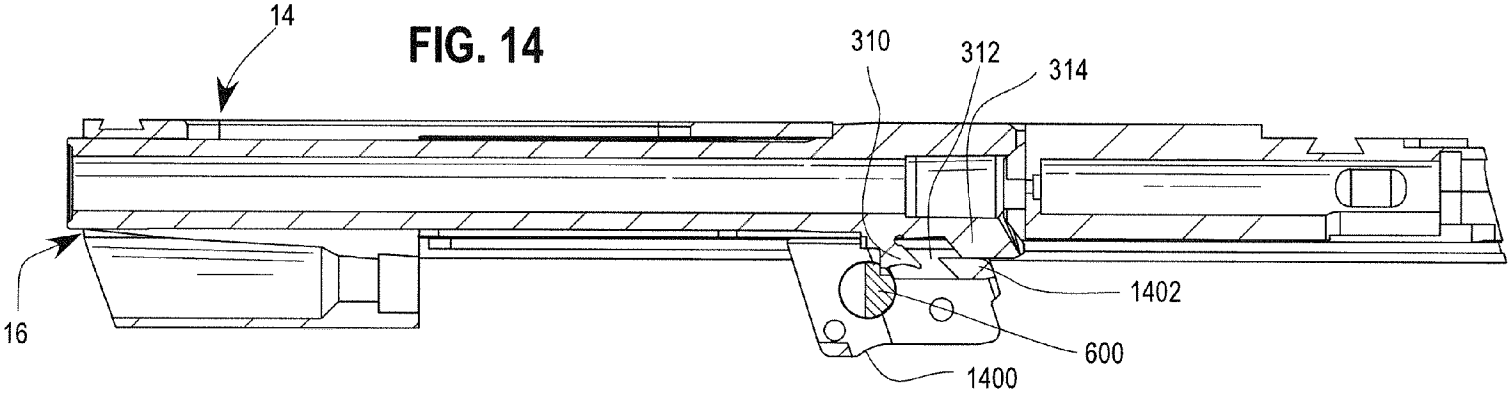
FIG. 14 is a cross-sectional view of the portion of the firearm in the locked position.

Referring first to FIGS. 13 and 14, the firearm 10 is in the locked position prior to firing. As shown previously in FIGS. 9-12, the barrel 16 is moved forward, causing the vertical face of the follower notch 308 to contact and bear against the vertical face of the second notch 612 of the takedown lever 600. As previously described, there is no additional contact between the barrel 16 and the takedown lever 600. Additionally, as previously described in FIGS. 3-5, the rear lug 314 of the barrel 16 is configured such that the front portion of the rear lug 314 is supported on the rear portion of the upper projection 1402 of the locking block 1400. The barrel 16 is thereby restrained against forward movement only by the contact between the follower lug 310 and the takedown lever 600, and restrained against downward movement only by the contact between the rear lug 314 and the upper projection 1402.

Figure 15:
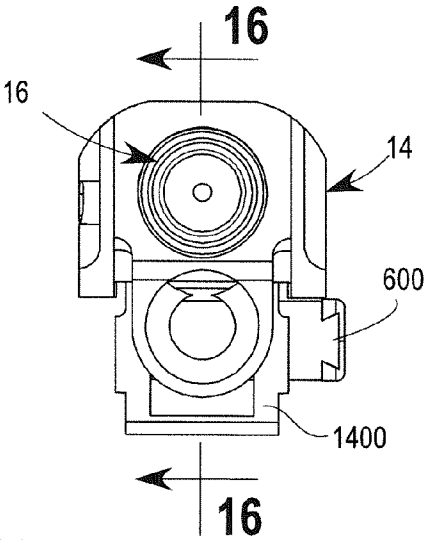
FIG. 15 is a front elevational view of a portion of the firearm in an initial recoil position.
Figure 16:
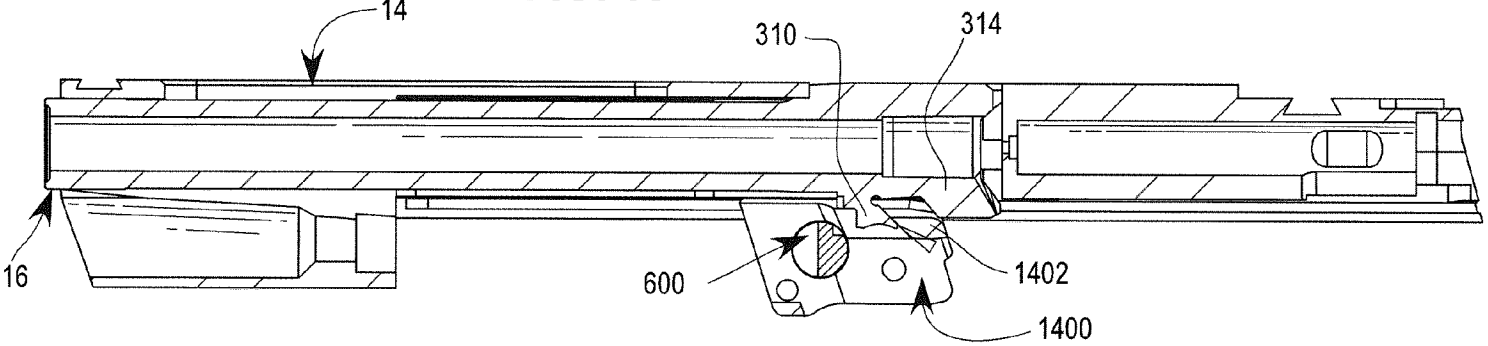
FIG. 16 is a cross-sectional view of the portion of the firearm in the initial recoil position.

Referring next to FIGS. 15 and 16, during the initial recoil impulse after firing the firearm 10, the barrel 16 and slide 14 travel rearward generally along the firing axis 18. As the barrel 16 and slide 14 travel rearward, for a period of time the barrel 16 continues to be restrained against downward movement as the rear lug 314 slides along the surface of the upper projection 1402 of the locking block 1400. As the barrel 16 continues to travel rearward, the rear angled surface of the follower lug 310 contacts the forward angled surface of the upper projection 1402 of the locking block 1400, and the barrel 16 starts to angle downward as guided by the contact between the locking block 1400 and the follower lug 310. The width of the recess groove 312 between the follower lug 310 and the rear lug 314 is configured such that when the follower lug 310 contacts the upper projection 1402, the rear lug 314 is positioned such that the rear lug 314 also slides downward, and is not prevented from sliding downward by contact with the rear portion of the upper projection 1402.

Figure 17:
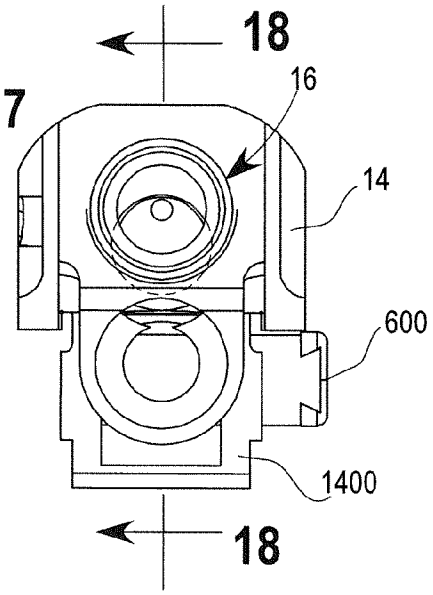
FIG. 17 is a front elevational view of the portion of the firearm in an intermediate recoil position.
Figure 18:
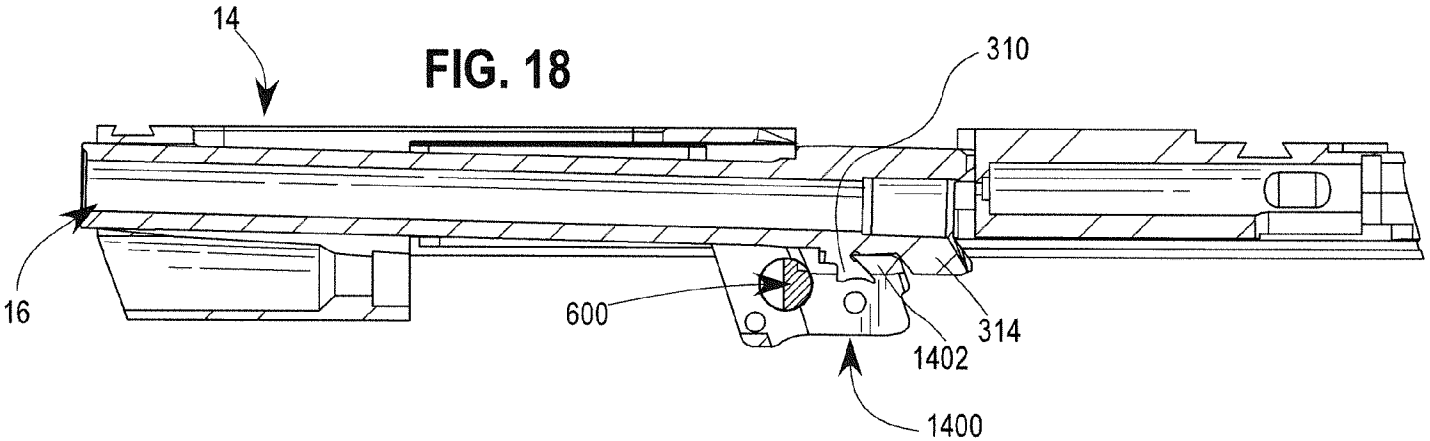
FIG. 18 is a cross-sectional view of the portion of the firearm in the intermediate recoil position.

Referring next to FIGS. 17 and 18, the barrel 16 has continued to travel rearward and at a downward angle until the travel is stopped by contact between the recess groove 312 and the top surface of the upper projection 1402 of the locking block 1400. In this position, the barrel 16 is tilted downwards towards the rear of the firearm 10 to the fullest extent. The barrel 16 and slide 14 remain locked together.

Figure 19:
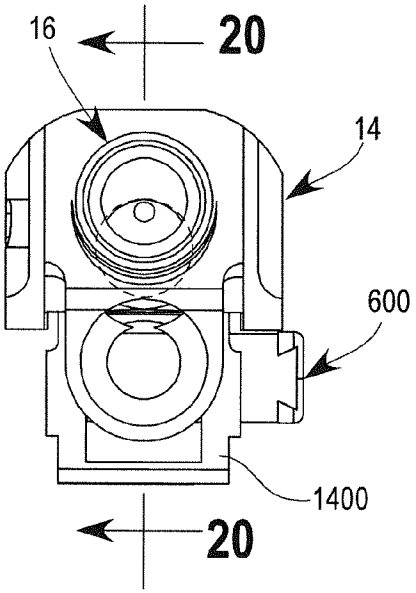
FIG. 19 is a front elevational view of the portion of the firearm in a final recoil position.
Figure 20:
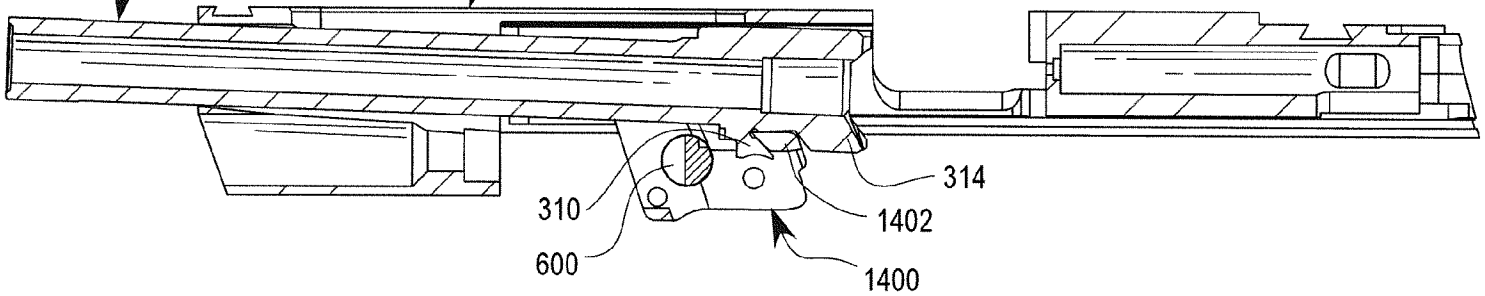
FIG. 20 is a cross-sectional view of the portion of the firearm in the final recoil position.

Referring next to FIGS. 19 and 20, the downward tilt of the barrel 16 allows the slide 14 to unlock from the barrel 16. The rearward movement of the barrel 16 has been arrested by the contact between the upper projection 1402 and the recess groove 312. The slide 14 then continues to travel rearward and eject the spent cartridge. The firearm 10 then loads the next cartridge (not shown) and returns to the locked position of FIGS. 13 and 14.

Referring again to FIGS. 13-20, the present invention, including the modifications to the barrel 16 and the takedown lever 600, increases the accuracy of the firearm 10. The addition of the follower notch 308 and of the second notch 612 of the takedown lever 600 causes the barrel 16 to be locked in a precise position each time the firearm 10 is locked prior to firing. The precise position results in less variation in rearward movement of the barrel 16 after firing.

Additionally, the invention increases the dwell time of the firearm 10. The dwell time is the time period after firing when the barrel 16 and slide 14 travel together in a fixed relationship. A longer dwell time ensures that the orientation of the barrel 16 relative to the slide 14 remains constant until well after a bullet has exited the barrel 16, keeping the slide/barrel relationship constant throughout the firing process and thus increasing accuracy.

The increase in length of the rear lug 314 also provides a precise support, supporting the barrel 16 against downward movement and ensuring that the barrel 16 is supported vertically during the initial firing stages, as the rear lug 314 slides along the upper projection 1402. Maintaining the barrel 16 in the substantially horizontal position during the initial firing increases the accuracy of the firearm 10, as early tilting of the barrel 16 downward, as occurs with the firearm 10 configurations known in the art, alters the trajectory of the bullet. The contact between the upper projection 1402 and the rear lug 314 in the locked position also results in consistent locking pressures on the barrel 16, again limiting variations in movement during the lockup and firing periods, which in turn increases the accuracy of the firearm 10.

Firearms of the prior art use only a ramped surface bearing against a rounded surface of the takedown lever 600 to maintain the relationship between the barrel 16 and the slide 14 after firing, resulting in a shorter dwell time. The prior art design requires that a constant forward force act on the barrel 16 in order for the ramped surface to bear against the round surface of the takedown lever 600. Variations in the cartridge pressure curve from shot to shot result in variable vertical lock-up forces, which in turn causes inconsistent accuracy.

Additionally, in some embodiments of the present invention the external diameter of the front portion 300 of the barrel 16 is increased approximately 0.005". The external diameter results in less movement of the barrel 16 within the slide 14 during the locked position and during an initial firing period. The reduction in movement within the barrel 16 ("wobble") also increases accuracy by lessening the variations of movement within the firearm 10 during the lockup and firing periods.

In some embodiments, the accuracy of the firearm 10 of the present invention is increased to impact within a 4" diameter circle from 50 meters for at least 90% of the firing attempts. In some embodiments, the accuracy is increased to impact within a 2" diameter circle from 50 meters for at least 90% of the firing attempts.

While the invention herein disclosed has been described by means of specific embodiments, examples and applications thereof, numerous modifications and variations could be made thereto by those skilled in the art without departing from the scope of the invention set forth in the claims.

What is claimed is:

1. A barrel assembly for a firearm, comprising:

a barrel comprising:

a follower lug extending downward from an underside of a rear portion of the barrel proximate to a front portion of the barrel, the follower lug including a follower notch in a bottom portion of a front face of the follower lug, the follower notch including a vertical follower notch face facing frontwards; and a takedown lever mechanically cooperated with the barrel and a locking block of the firearm, the takedown lever including a cylindrical pin rotationally coupled to the locking block and a notch in a top portion of the pin and facing rearwards, the notch including a substantially vertical notch face facing rearward and a substantially horizontal notch face facing upward, wherein when the barrel is moved forward to place the firearm in a locked position, the vertical follower notch face contacts the vertical notch face, whereby further forward movement of the barrel is prevented.

2. The barrel assembly for the firearm of claim 1, further comprising:

a rear lug extending downward from the underside of the rear portion distal to the front portion of the barrel, the rear lug including a generally horizontal bottom surface configured to be supported by an upper projection of the locking block while in the locked position and during an initial recoil period of the firearm.

3. The barrel assembly for the firearm of claim 2, whereby the barrel assembly is configured such that when the firearm including the barrel assembly is repeatedly fired at a target from substantially 50 meters, at least 90% of the firings will result in an impact on the target within a 4 inch diameter circle.

4. The barrel assembly for the firearm of claim 1, the notch tapering at each end of the notch.

5. The barrel assembly for the firearm of claim 1, the follower lug and the notch further configured such that, when the vertical follower notch face contacts the vertical notch face, the horizontal notch face does not contact the follower lug.

6. The barrel assembly for the firearm of claim 1, wherein an external diameter of the front portion of the barrel is increased by substantially 0.005 inches, whereby wobble of the barrel within a slide of the firearm is reduced during an initial firing period.

* * * * *